US008302620B2

(12) United States Patent
Lin

(10) Patent No.: US 8,302,620 B2
(45) Date of Patent: Nov. 6, 2012

(54) WATER INLET/OUTLET ASSEMBLY FOR FAUCET

(76) Inventor: Wen-Tsung Lin, Tsailiao Village (TW)

( * ) Notice: Subject to any disclaimer, the term of this patent is extended or adjusted under 35 U.S.C. 154(b) by 363 days.

(21) Appl. No.: 12/689,539

(22) Filed: Jan. 19, 2010

(65) Prior Publication Data

US 2011/0174403 A1 Jul. 21, 2011

(51) Int. Cl.
*F16K 5/00* (2006.01)

(52) U.S. Cl. ..... 137/315.12; 137/603; 137/801; 4/678; 285/376; 285/402

(58) Field of Classification Search ..... 137/315.12, 137/602, 603, 896, 801; 4/675–678; 285/401, 285/402, 376, 921, 55
See application file for complete search history.

(56) References Cited

U.S. PATENT DOCUMENTS

| | | | | |
|---|---|---|---|---|
| 7,404,413 | B2 * | 7/2008 | Chang | 137/606 |
| 2008/0196776 | A1 * | 8/2008 | Ko | 137/603 |
| 2010/0096034 | A1 * | 4/2010 | Hou | 137/801 |
| 2010/0243088 | A1 * | 9/2010 | Wu | 137/801 |

* cited by examiner

*Primary Examiner* — Craig Schneider
*Assistant Examiner* — Ian Paquette
(74) *Attorney, Agent, or Firm* — Alan Kamrath; Kamrath IP Lawfirm, PA

(57) ABSTRACT

A water inlet/outlet assembly for a faucet includes a fore-injection molding dividing unit, a post-injection molding connecting unit and at least one supply pipe. The fore-injection molding dividing unit includes at least one water inlet pipe and a water outlet pipe. The water inlet pipe has at least one catch portion, at least one limit opening and at least one retaining slot. The post-injection molding connecting unit coats the water inlet pipe and is combined with the catch portion, the limit opening and the retaining slot to enhance combination strength between the post-injection molding connecting unit and the fore-injection molding dividing unit. The supply pipe has at least one axial breach, at least one mortise and two journals. The post-injection molding connecting unit coats the supply pipe and is combined with the axial breach, the mortise and the journals.

18 Claims, 6 Drawing Sheets

WATER INLET/OUTLET ASSEMBLY FOR FAUCET

BACKGROUND OF THE INVENTION

1. Field of the Invention

The present invention relates to a faucet and, more particularly, to a water inlet/outlet assembly for a faucet with mixed cold and hot water.

2. Description of the Related Art

A conventional water inlet/outlet assembly for a faucet comprises a first connecting line formed by a first injection molding process and a second connecting line formed by a second injection molding process. The second connecting line is combined with the first connecting line during the second injection molding process to construct the water inlet/outlet assembly. Thus, the water inlet/outlet assembly is made by two injection molding processes. However, the second connecting line is not combined with the first connecting line solidly and exactly, so that the second connecting line is easily rotatable relative to the first connecting line. In addition, the second connecting line is not combined with the first connecting line tightly, so that a clearance is defined between the second connecting line and the first connecting line, thereby easily producing a leakage due to a larger water pressure.

BRIEF SUMMARY OF THE INVENTION

In accordance with the present invention, there is provided a water inlet/outlet assembly for a faucet, comprising a fore-injection molding dividing unit and a post-injection molding connecting unit coating the fore-injection molding dividing unit. The fore-injection molding dividing unit includes at least one water inlet pipe and a water outlet pipe connected with the water inlet pipe. The water inlet pipe of the fore-injection molding dividing unit has an outer periphery provided with at least one protruding catch portion and at least one limit opening connected with the catch portion. The water inlet pipe of the fore-injection molding dividing unit has an outer surface provided with at least one retaining slot spaced from the catch portion. The post-injection molding connecting unit coats the water inlet pipe of the fore-injection molding dividing unit. The post-injection molding connecting unit is combined with the catch portion, the limit opening and the retaining slot of the water inlet pipe.

The water inlet/outlet assembly further comprises at least one supply pipe combined with the post-injection molding connecting unit and connected to the fore-injection molding dividing unit through the post-injection molding connecting unit. The supply pipe has an upper end having a periphery provided with at least one axial breach and having an inner wall provided with at least one mortise. The supply pipe has two opposite sides each having an inner wall provided with a journal. The post-injection molding connecting unit coats the supply pipe. The post-injection molding connecting unit is combined with the axial breach, the mortise and the journal of the supply pipe.

According to the primary objective of the present invention, the post-injection molding connecting unit is provided with at least one stop portion locked in the limit opening of the water inlet pipe and abutting the catch portion of the water inlet pipe and at least one retaining flange locked in the retaining slot of the water inlet pipe to enhance the axial and radial combination strength between the post-injection molding connecting unit and the fore-injection molding dividing unit.

According to another objective of the present invention, the post-injection molding connecting unit is provided with at least one sealing groove integrally combined with the sealing ring of the water inlet pipe to provide an excellent sealing effect between the post-injection molding connecting unit and the fore-injection molding dividing unit and to prevent leakage between the post-injection molding connecting unit and the fore-injection molding dividing unit due to an excessive pressure.

According to a further objective of the present invention, the post-injection molding connecting unit is provided with at least one axial lug locked in the axial breach of the supply pipe, at least one tenon locked in the mortise of the supply pipe and at least one collar locked in the journal of the supply pipe to enhance the axial and radial combination strength between the post-injection molding connecting unit and the supply pipe.

According to a further objective of the present invention, when the fore-injection molding dividing unit is placed and molded in the die, the fore-injection molding dividing unit is positioned in the die cavity of the die solidly and stably by provision of the catch portion of the water inlet pipe.

According to a further objective of the present invention, the limit opening of the water inlet pipe allows passage of the fused plastic liquid during the injection molding process.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
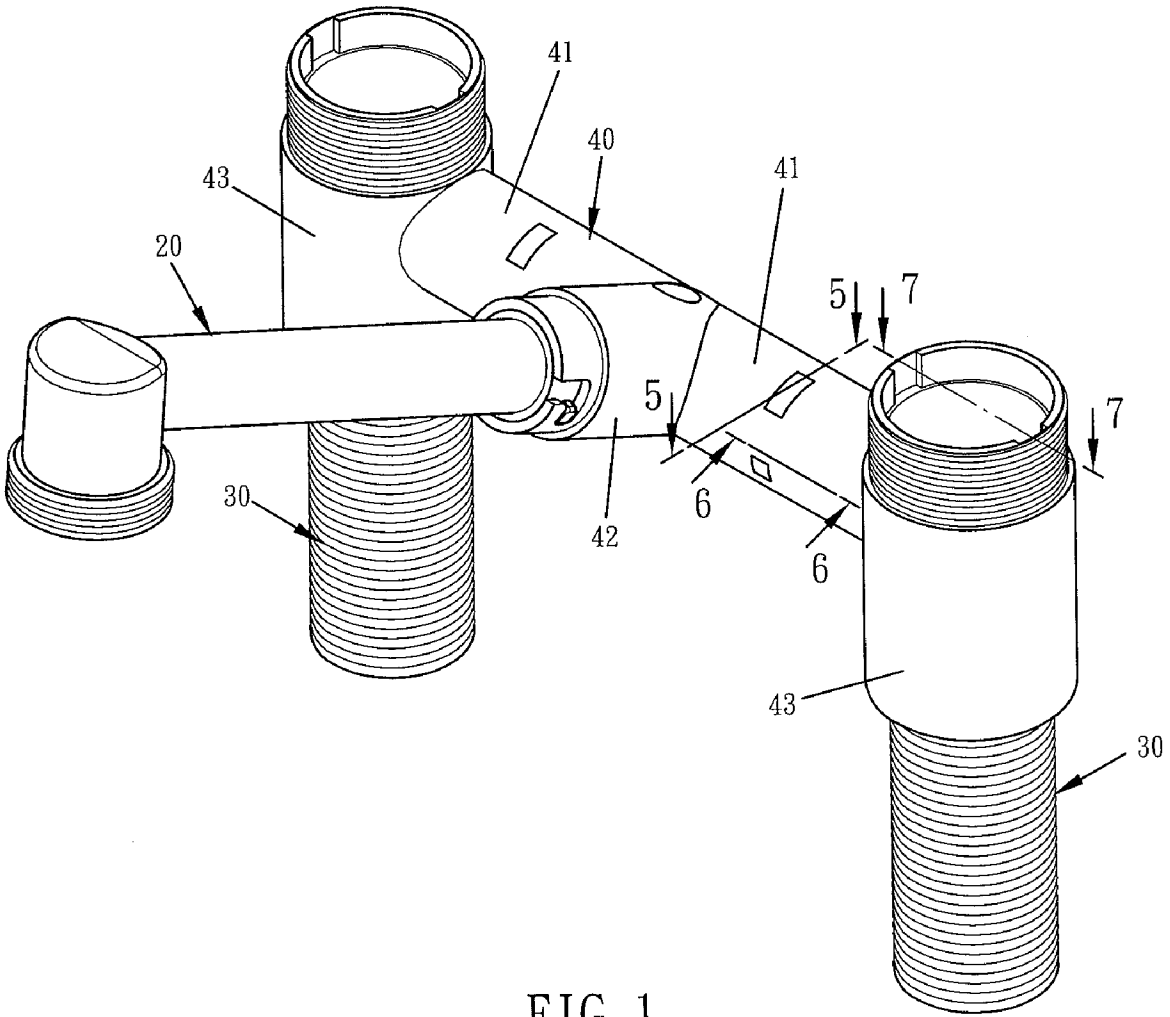
FIG. 1 is a perspective view of a water inlet/outlet assembly for a faucet in accordance with the preferred embodiment of the present invention.
Figures 2, 3:
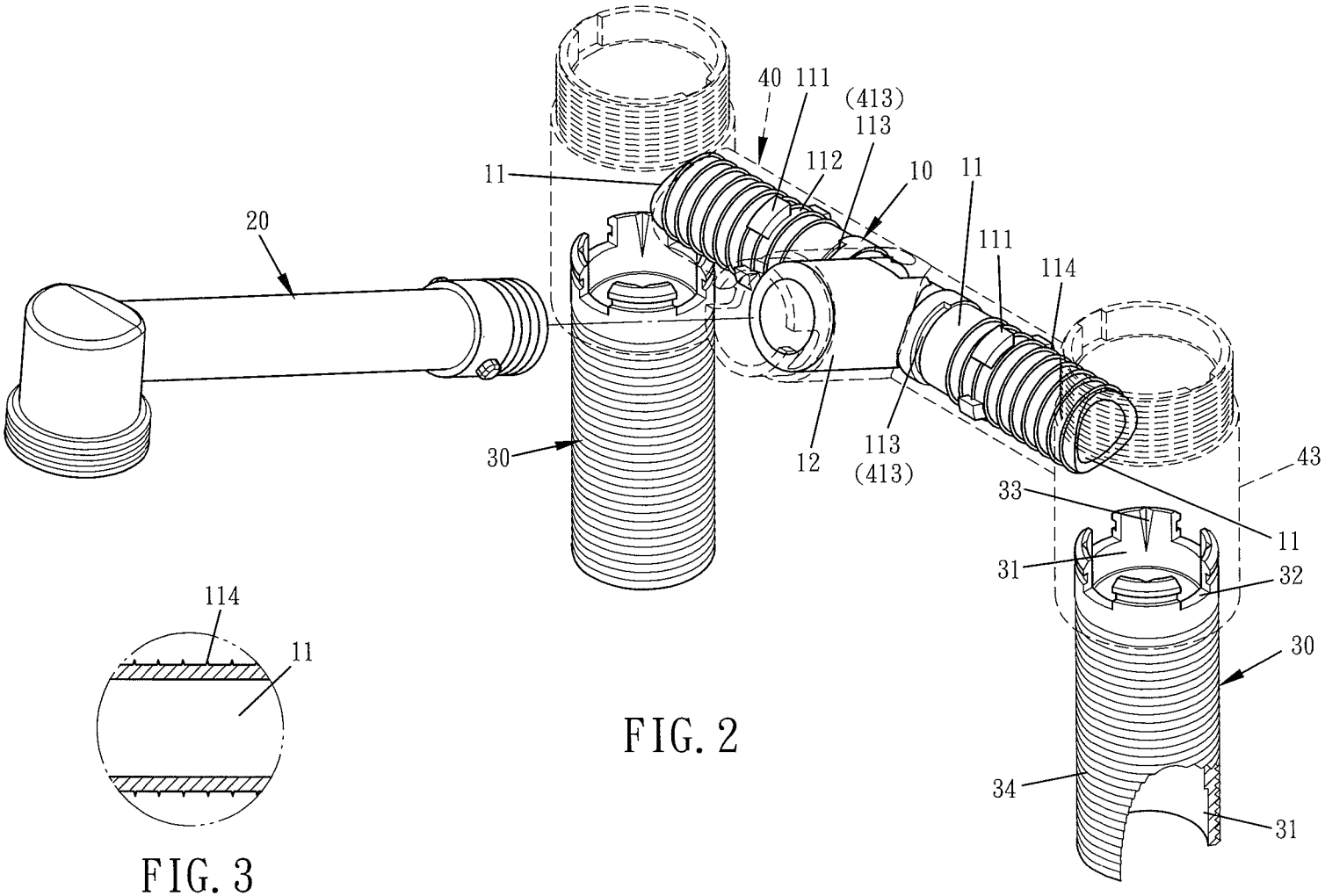
FIG. 2 is a partially exploded perspective view of the water inlet/outlet assembly for a faucet as shown in FIG. 1.
FIG. 3 is a front enlarged cross-sectional view of the water inlet/outlet assembly for a faucet as shown in FIG. 2.

Referring to the drawings and initially to FIGS. 1-7, a water inlet/outlet assembly in accordance with the preferred embodiment of the present invention comprises a fore-injection molding dividing unit 10, a post-injection molding connecting unit 40 coating the fore-injection molding dividing unit 10, at least one supply pipe 30 combined with the post-injection molding connecting unit 40 and connected to the fore-injection molding dividing unit 10 through the post-injection molding connecting unit 40, and a spout unit 20 combined with the post-injection molding connecting unit 40 and connected to the fore-injection molding dividing unit 10 through the post-injection molding connecting unit 40.

The fore-injection molding dividing unit 10 is made of plastic material and is formed by a fore-injection molding process. The fore-injection molding dividing unit 10 includes at least one water inlet pipe 11 and a water outlet pipe 12 connected with the water inlet pipe 11. The water inlet pipe 11 of the fore-injection molding dividing unit 10 has an outer periphery provided with at least one protruding catch portion 111 and at least one limit opening 112 connected with the catch portion 111. The water inlet pipe 11 of the fore-injection molding dividing unit 10 has an outer surface provided with at least one retaining slot 113 spaced from the catch portion 111. The water inlet pipe 11 of the fore-injection molding dividing unit 10 has an outer side provided with at least one sealing ring 114. The sealing ring 114 of the water inlet pipe 11 has a pointed shape. The catch portion 111 and the limit opening 112 of the water inlet pipe 11 are located between the retaining slot 113 and the sealing ring 114 of the water inlet pipe 11.

The spout unit 20 is made of plastic material and is formed by a fore-injection molding process. The spout unit 20 is connected with the water outlet pipe 12 of the fore-injection molding dividing unit 10.

The supply pipe 30 is made of metallic material. The supply pipe 30 has an outer wall provided with an outer thread 34. The supply pipe 30 has an upper end having a periphery provided with at least one axial breach 32 and having an inner wall provided with at least one mortise 33. The supply pipe 30 has two opposite sides each having an inner wall provided with a journal 31. The journal 31 of the supply pipe 30 has a diameter greater than an inner diameter of the supply pipe 30.

The post-injection molding connecting unit 40 is made of plastic material and is formed by a post-injection molding process. The post-injection molding connecting unit 40 coats the water inlet pipe 11 and the water outlet pipe 12 of the fore-injection molding dividing unit 10 and is combined with the catch portion 111, the limit opening 112 and the retaining slot 113 of the water inlet pipe 11. The post-injection molding connecting unit 40 is also combined with the sealing ring 114 of the water inlet pipe 11. The post-injection molding connecting unit 40 also coats the supply pipe 30 and is combined with the axial breach 32, the mortise 33 and the journal 31 of the supply pipe 30.

The post-injection molding connecting unit 40 includes at least one first coating layer 41 coating the water inlet pipe 11 of the fore-injection molding dividing unit 10, a second coating layer 42 connected with the first coating layer 41 and coating the water outlet pipe 12 of the fore-injection molding dividing unit 10, and at least one connecting pipe 43 connected between the first coating layer 41 and the supply pipe 30 to connect the water inlet pipe 11 of the fore-injection molding dividing unit 10 to the supply pipe 30.

The first coating layer 41 of the post-injection molding connecting unit 40 has an inner periphery provided with at least one protruding stop portion 411 locked in the limit opening 112 of the water inlet pipe 11 and abutting the catch portion 111 of the water inlet pipe 11. The first coating layer 41 of the post-injection molding connecting unit 40 has an inner periphery provided with at least one protruding retaining flange 413 locked in the retaining slot 113 of the water inlet pipe 11. The first coating layer 41 of the post-injection molding connecting unit 40 has an inner side provided with at least one sealing groove 414 integrally combined with the sealing ring 114 of the water inlet pipe 11. The second coating layer 42 of the post-injection molding connecting unit 40 is detachably connected with the spout unit 20.

The connecting pipe 43 of the post-injection molding connecting unit 40 has a lower end provided with a reduced inner tube 430 inserted into the supply pipe 30. The inner tube 430 of the connecting pipe 43 has a periphery provided with at least one protruding axial lug 432 locked in the axial breach 32 of the supply pipe 30 and has an outer wall provided with at least one protruding tenon 433 locked in the mortise 33 of the supply pipe 30. The inner tube 430 of the connecting pipe 43 has two opposite sides each having an outer wall provided with a collar 431 locked in the journal 31 of the supply pipe 30. The collar 431 of the connecting pipe 43 has a diameter greater than an outer diameter of the inner tube 430.

In the preferred embodiment of the present invention, the fore-injection molding dividing unit 10 has a T-shaped profile and includes two water inlet pipes 11 and a water outlet pipe 12 connected with the water inlet pipes 11. In addition, the water inlet/outlet assembly comprises two supply pipes 30 each combined with the post-injection molding connecting unit 40 and each connected to a respective one of the water inlet pipes 11 of the fore-injection molding dividing unit 10 through the post-injection molding connecting unit 40. In addition, the post-injection molding connecting unit 40 includes two first coating layers 41 coating the two water inlet pipes 11 of the fore-injection molding dividing unit 10 respectively, a second coating layer 42 connected with the first coating layers 41 respectively, and two connecting pipes 43 each connected between a respective one of the first coating layers 41 and a respective one of the supply pipes 30 to connect the respective water inlet pipe 11 of the fore-injection molding dividing unit 10 to the respective supply pipe 30.

In fabrication of the water inlet/outlet assembly for a faucet, the fore-injection molding dividing unit 10, the spout unit 20 and the supply pipe 30 are formed individually. Then, the fore-injection molding dividing unit 10 and the supply pipe 30 are placed and molded in a die to form the post-injection molding connecting unit 40 in an embedded injection manner so that the post-injection molding connecting unit 40 coats the water inlet pipe 11 and the water outlet pipe 12 of the fore-injection molding dividing unit 10 and also coats the supply pipe 30. Finally, the spout unit 20 is combined with the post-injection molding connecting unit 40 to construct the water inlet/outlet assembly.

In such a manner, the post-injection molding connecting unit 40 is provided in the injection molding process with the stop portion 411 locked in the limit opening 112 of the water inlet pipe 11 and abutting the catch portion 111 of the water inlet pipe 11, with the retaining flange 413 locked in the retaining slot 113 of the water inlet pipe 11 and with the sealing groove 414 locked onto the sealing ring 114 of the water inlet pipe 11. In addition, the post-injection molding connecting unit 40 is also provided in the injection molding process with the inner tube 430 inserted into the supply pipe 30, with the axial lug 432 locked in the axial breach 32 of the supply pipe 30, with the tenon 433 locked in the mortise 33 of the supply pipe 30 and with the collar 431 locked in the journal 31 of the supply pipe 30.

At this time, when the fore-injection molding dividing unit 10 is placed and molded in the die, the fore-injection molding dividing unit 10 is positioned in the die cavity of the die solidly and stably by provision of the catch portion 111 of the water inlet pipe 11. In addition, the limit opening 112 of the water inlet pipe 11 allows passage of the fused plastic liquid during the injection molding process.

Figure 4:
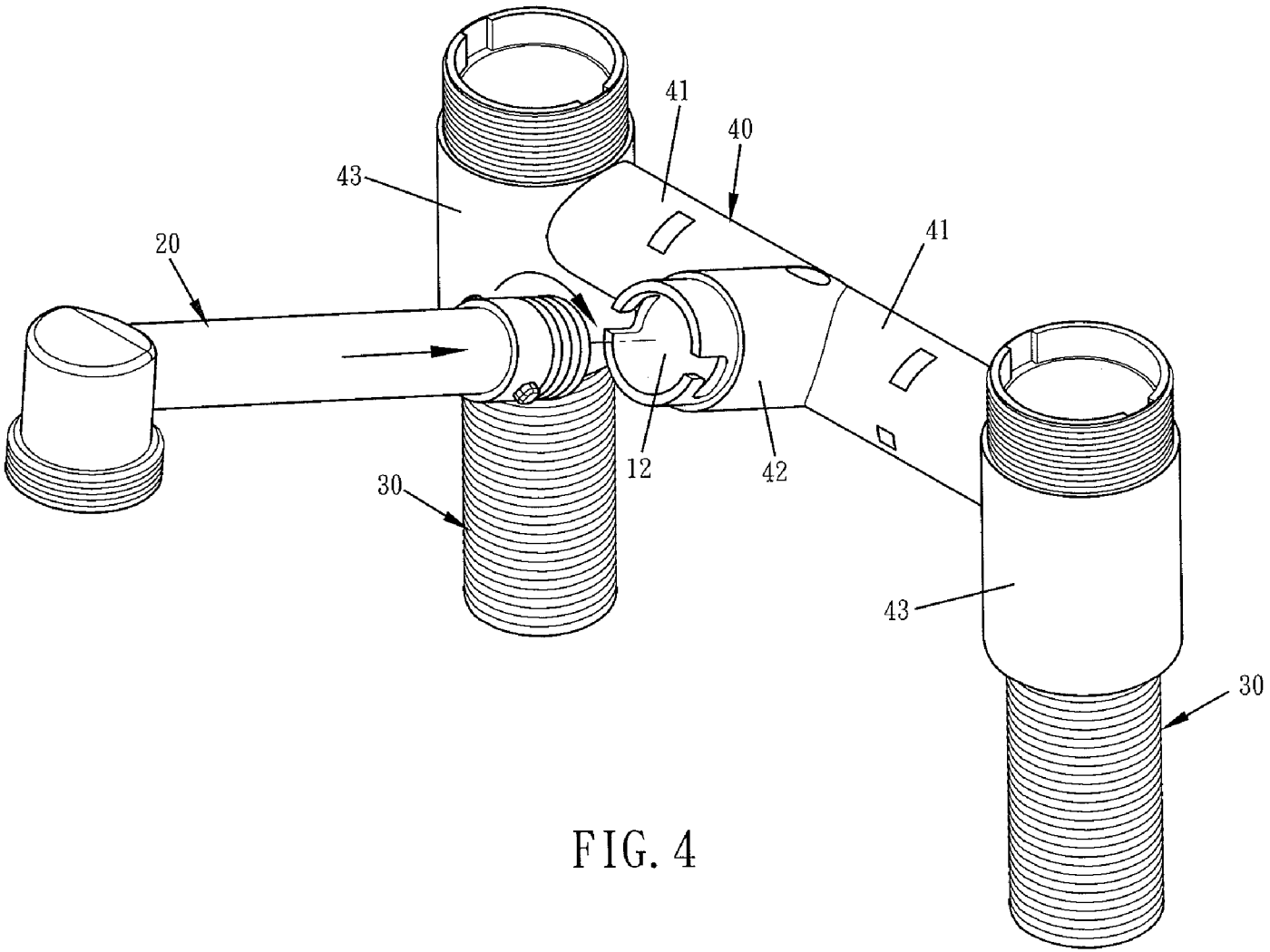
FIG. 4 is an exploded perspective view of the water inlet/outlet assembly for a faucet as shown in FIG. 1.
Figure 6:
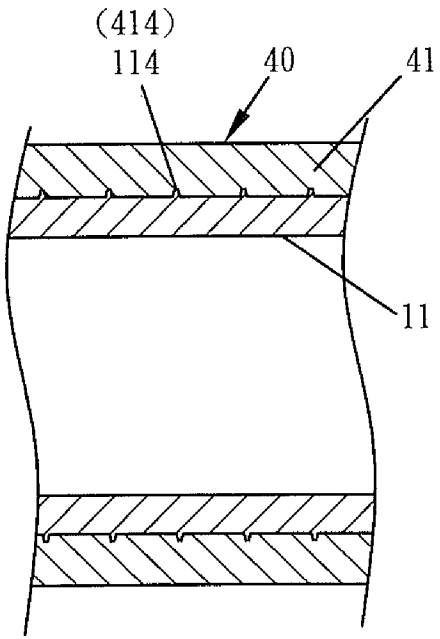
FIG. 6 is a cross-sectional view of the water inlet/outlet assembly for a faucet taken along line 6-6 as shown in FIG. 1.
Figure 5:
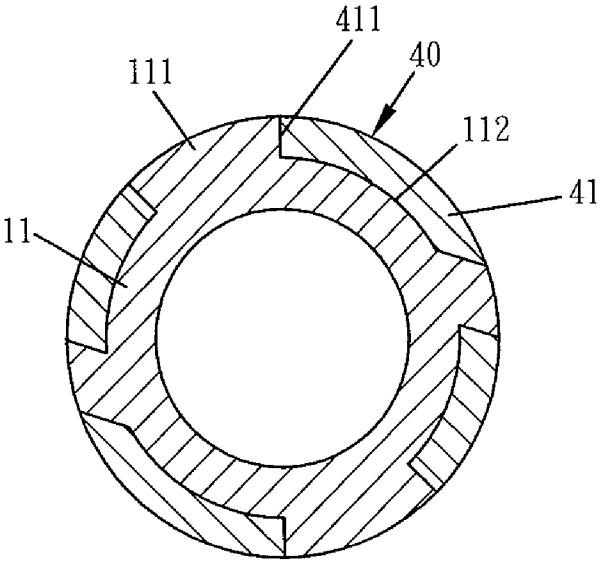
FIG. 5 is a cross-sectional view of the water inlet/outlet assembly for a faucet taken along line 5-5 as shown in FIG. 1.
Figure 7:
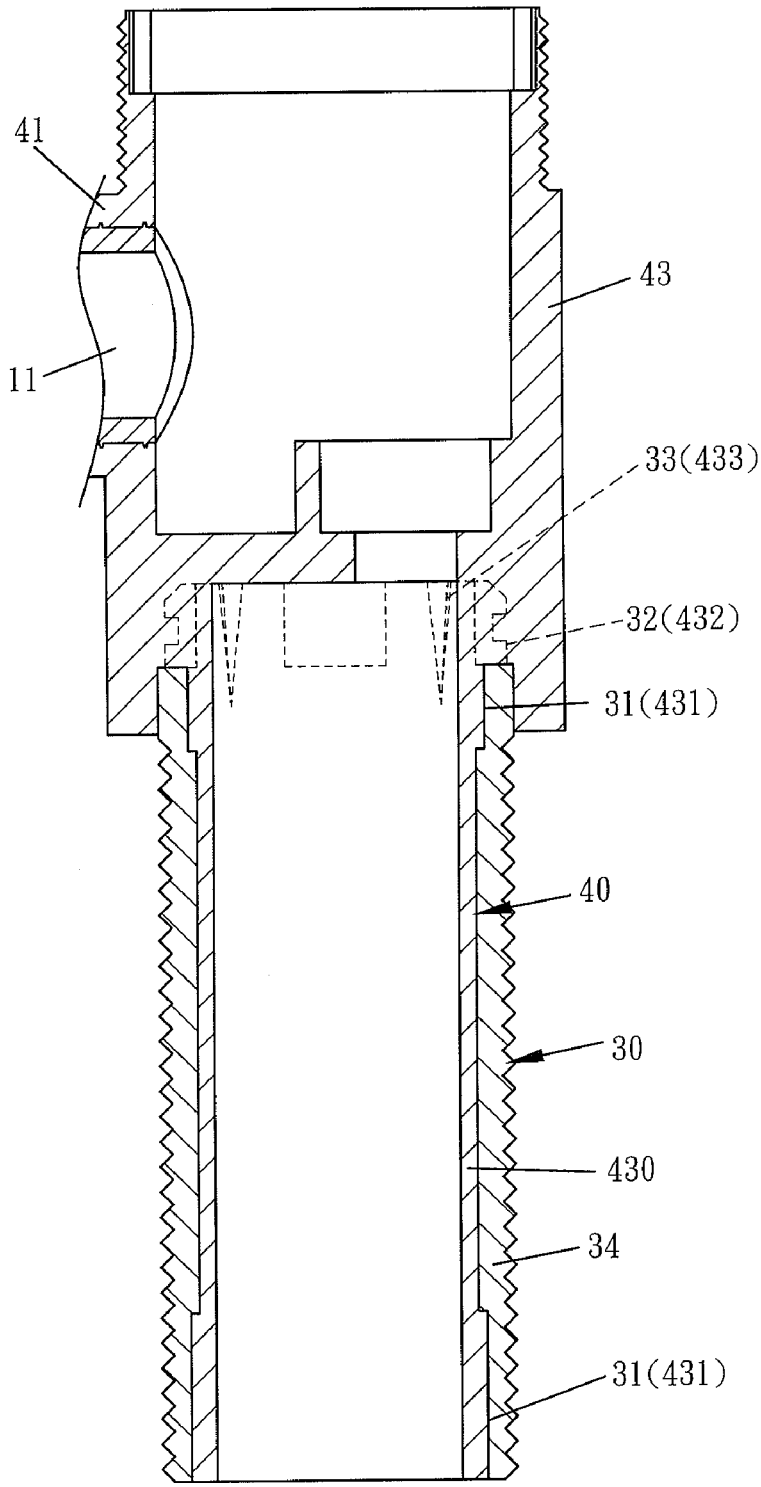
FIG. 7 is a cross-sectional view of the water inlet/outlet assembly for a faucet taken along line 7-7 as shown in FIG. 1.

As shown in FIG. 4, the spout unit 20 is detachably combined with the post-injection molding connecting unit 40.

Figure 8:
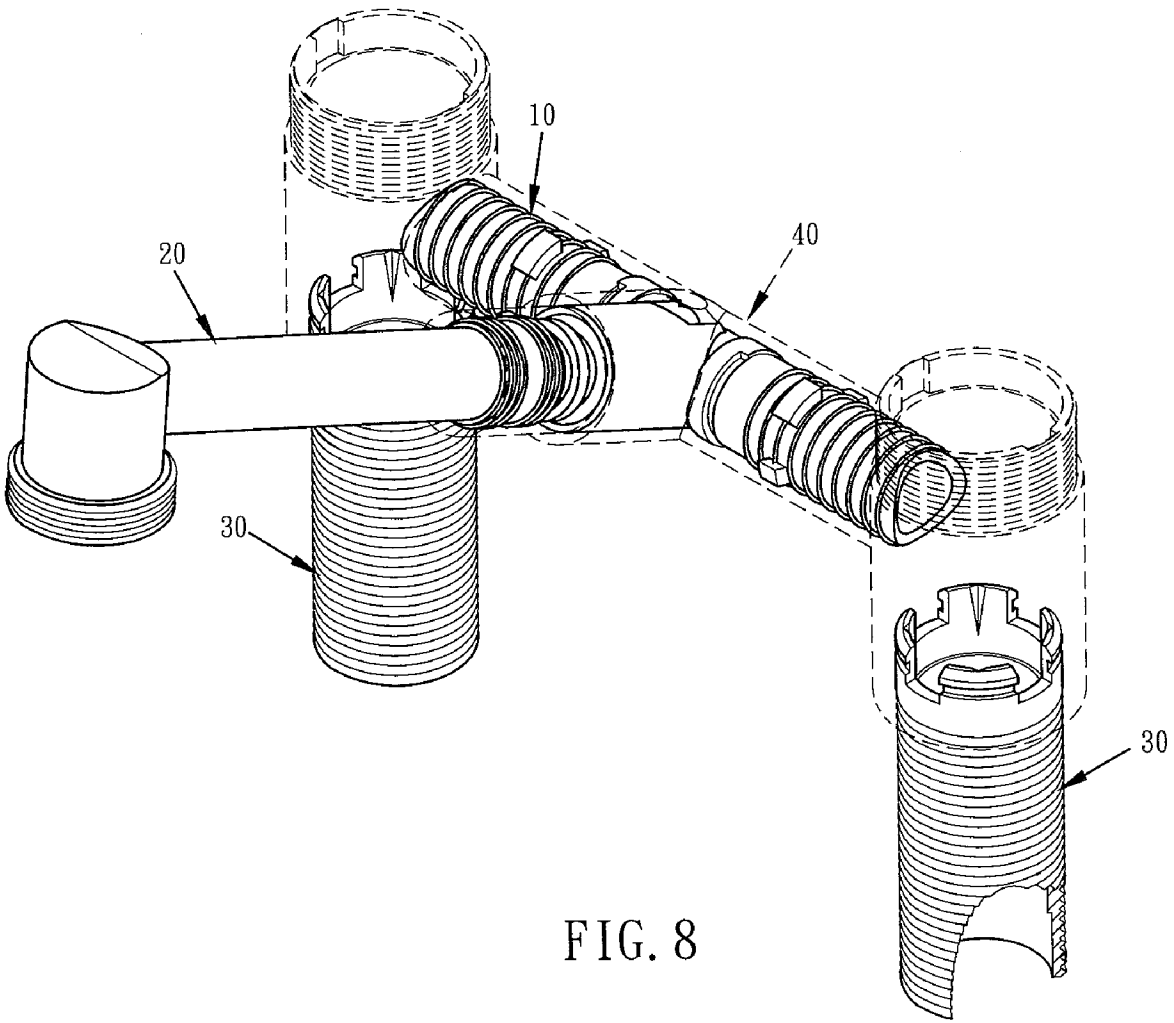
FIG. 8 is a perspective view of a water inlet/outlet assembly for a faucet in accordance with another preferred embodiment of the present invention.

As shown in FIG. 8, the spout unit 20 is integrally combined with the post-injection molding connecting unit 40, and the post-injection molding connecting unit 40 also coats the spout unit 20.

Accordingly, the post-injection molding connecting unit 40 is provided with at least one stop portion 411 locked in the limit opening 112 of the water inlet pipe 11 and abutting the catch portion 111 of the water inlet pipe 11 and with at least one retaining flange 413 locked in the retaining slot 113 of the water inlet pipe 11 to enhance the axial and radial combination strength between the post-injection molding connecting unit 40 and the fore-injection molding dividing unit 10. In addition, the post-injection molding connecting unit 40 is provided with at least one sealing groove 414 integrally combined with the sealing ring 114 of the water inlet pipe 11 to provide an excellent sealing effect between the post-injection molding connecting unit 40 and the fore-injection molding dividing unit 10 and to prevent leakage between the post-injection molding connecting unit 40 and the fore-injection molding dividing unit 10 due to an excessive pressure. Further, the post-injection molding connecting unit 40 is provided with at least one axial lug 432 locked in the axial breach 32 of the supply pipe 30, with at least one tenon 433 locked in the mortise 33 of the supply pipe 30 and with at least one collar 431 locked in the journal 31 of the supply pipe 30 to enhance the axial and radial combination strength between the post-injection molding connecting unit 40 and the supply pipe 30. Further, when the fore-injection molding dividing unit 10 is placed and molded in the die, the fore-injection molding dividing unit 10 is positioned in the die cavity of the die solidly and stably by provision of the catch portion 111 of the water inlet pipe 11. Further, the limit opening 112 of the water inlet pipe 11 allows passage of the fused plastic liquid during the injection molding process.

Although the invention has been explained in relation to its preferred embodiment(s) as mentioned above, it is to be understood that many other possible modifications and variations can be made without departing from the scope of the present invention. It is, therefore, contemplated that the appended claims will cover such modifications and variations that fall within the true scope of the invention.

The invention claimed is:

1. A water inlet/outlet assembly for a faucet comprising:

a fore-injection molding dividing unit;

a post-injection molding connection unit coating the fore-injection molding dividing unit, wherein the fore-injection molding dividing unit includes at least one water inlet pipe and a water outlet pipe connected with the water inlet pipe, wherein the water inlet pipe of the fore-injection molding dividing unit has an outer periphery provided with at least one protruding catch portion and at least on limit opening connected with the catch portion, wherein the water inlet pipe of the fore-injection molding dividing unit has an outer surface provided with at least one retaining slot spaced from the catch portion, wherein the post-injection molding connecting unit coats the water inlet pipe of the fore-injection molding dividing unit, wherein the post-injection molding connecting unit is combined with the catch portion, the limit opening and the retaining slot of the water inlet pipe; and at least one supply pipe combined with the post-injection molding connecting unit and connected to the fore-injection molding dividing unit through the post-injection molding connecting unit;

wherein the supply pipe has an upper end having a periphery provided with at least one axial breach and having an inner wall provided with at least one mortise;

wherein the supply pipe has two opposite sides each having an inner wall provided with a journal;

wherein the post-injection molding connecting unit coats the supply pipe; and wherein the post-injection molding connecting unit is combined with the axial breach, the mortise and the journal of the supply pipe.

2. The water inlet/outlet assembly for a faucet of claim 1, wherein the supply pipe is made of metallic material.

3. The water inlet/outlet assembly for a faucet of claim 1, wherein the supply pipe has an outer wall provided with an outer thread.

4. The water inlet/outlet assembly for a faucet of claim 1, wherein the post-injection molding connecting unit coats the water outlet pipe of the fore-injection molding dividing unit.

5. The water inlet/outlet assembly for a faucet of claim 1, wherein the water inlet pipe of the fore-injection molding dividing unit has an outer side provided with at least one sealing ring; and wherein the post-injection molding connecting unit is combined with the sealing ring of the water inlet pipe.

6. The water inlet/outlet assembly for a faucet of claim 5, wherein the sealing ring of the water inlet pipe has a pointed shape.

7. The water inlet/outlet assembly for a faucet of claim 5, wherein the catch portion and the limit opening of the water inlet pipe are located between the retaining slot and the sealing ring of the water inlet pipe.

8. The water inlet/outlet assembly for a faucet of claim 1, further comprising:

a spout unit combined with the post-injection molding connecting unit and connected to the fore-injection molding dividing unit through the post-injection molding connecting unit.

9. The water inlet/outlet assembly for a faucet of claim 8, wherein the spout unit is detachably combined with the post-injection molding connecting unit.

10. The water inlet/outlet assembly for a faucet of claim 8, wherein:

the spout unit is integrally combined with the post-injection molding connecting unit; and the post-injection molding connecting unit coats the spout unit.

11. The water inlet/outlet assembly for a faucet of claim 1, wherein the post-injection molding connecting unit includes:

at least one first coating layer coating the water inlet pipe of the fore-injection molding dividing unit;

a second coating layer connected with the first coating layer and coating the water outlet pipe of the fore-injection molding dividing unit; and at least one connecting pipe connected between the first coating layer and the supply pipe to connect the water inlet pipe of the fore-injection molding dividing unit to the supply pipe.

12. The water inlet/outlet assembly for a faucet of claim 11, wherein:

the first coating layer of the post-injection molding connecting unit has an inner periphery provided with at least one protruding stop portion locked in the limit opening of the water inlet pipe and abutting the catch portion of the water inlet pipe; and the first coating layer of the post-injection molding connecting unit has an inner periphery provided with at least one protruding retaining flange locked in the retaining slot of the water inlet pipe.

13. The water inlet/outlet assembly for a faucet of claim 11, wherein:

the water inlet pipe of the fore-injection molding dividing unit has an outer side provided with at least one sealing ring; and the first coating layer of the post-injection molding connecting unit has an inner side provided with at least one sealing groove integrally combined with the sealing ring of the water inlet pipe.

14. The water inlet/outlet assembly for a faucet of claim 11, wherein:

the fore-injection molding dividing unit has a T-shaped profile and includes two water inlet pipes and a water outlet pipe connected with the water inlet pipes;

the water inlet/outlet assembly comprises two supply pipes each combined with the post-injection molding connecting unit and each connected to a respective one of the water inlet pipes of the fore-injection molding dividing unit through the post-injection molding connecting unit; and the post-injection molding connecting unit includes two first coating layers coating the two water inlet pipes of the fore-injection molding dividing unit respectively, a second coating layer connected with the first coating layers respectively, and two connecting tubes each connected between a respective one of the first coating layers and a respective one of the supply pipes to connect the respective water inlet pipe of the fore-injection molding dividing unit to the respective supply pipe.

15. The water inlet/outlet assembly for a faucet of claim 11, wherein:

the connecting pipe of the post-injection molding connecting unit has a lower end provided with a reduced inner tube insert into the supply pipe;

the inner tube of the connecting pipe has a periphery provided with at least one protruding axial lug locked in the axial breach of the supply pipe;

the inner tube of the connecting pipe has an outer wall provided with at least one protruding tenon locked in the mortise of the supply pipe; and the inner tube of the connecting pipe has two opposite sides each having an outer wall provided with a collar locked in the journal of the supply pipe.

16. The water inlet/outlet assembly for a faucet of claim 15, wherein:

the journal of the supply pipe has a diameter greater than an inner diameter of the supply pipe; and the collar of the connecting pipe has a diameter greater than an outer diameter of the inner tube.

17. The water inlet/outlet assembly for a faucet of claim 11, further comprising:

a spout unit combined with the post-injection molding connecting unit and connected to the fore-injection molding dividing unit through the post-injection molding connecting unit; and wherein the second coating layer of the post-injection molding connecting unit is detachably connected with the spout unit.

18. The water inlet/outlet assembly for a faucet of claim 17, wherein the spout unit is connected with the water outlet pipe of the fore-injection molding dividing unit through the second coating layer of the post-injection molding connecting unit.

* * * * *